US007506516B2

(12) United States Patent
Bruck et al.

(10) Patent No.: US 7,506,516 B2
(45) Date of Patent: Mar. 24, 2009

(54) CONCENTRIC CATALYTIC COMBUSTOR

(75) Inventors: Gerald J. Bruck, Oviedo, FL (US); Walter R. Laster, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 650 days.

(21) Appl. No.: 11/156,338

(22) Filed: Jun. 17, 2005

(65) Prior Publication Data

US 2007/0006595 A1 Jan. 11, 2007

Related U.S. Application Data

(63) Continuation-in-part of application No. 10/918,275, filed on Aug. 13, 2004.

(51) Int. Cl.
*F02C 7/22* (2006.01)
*F02C 7/26* (2006.01)

(52) U.S. Cl. ..... 60/777; 60/723

(58) Field of Classification Search ..... 60/723, 60/777, 39.822
See application file for complete search history.

(56) References Cited

U.S. PATENT DOCUMENTS 4,040,252 A * 8/1977 Mosier et al. ..... 60/804
4,072,007 A * 2/1978 Sanday ..... 60/723
4,162,993 A 7/1979 Retallick
4,240,784 A 12/1980 Dauvergne
4,265,085 A 5/1981 Fox et al.
4,350,617 A 9/1982 Retallick et al.
4,545,430 A 10/1985 Retallick
4,598,063 A 7/1986 Retallick
4,731,989 A * 3/1988 Furuya et al. ..... 60/775
4,870,824 A 10/1989 Young et al.
5,000,004 A * 3/1991 Yamanaka et al. ..... 60/723
5,232,357 A * 8/1993 Dalla Betta et al. ..... 431/7
5,278,125 A 1/1994 Iida et al.
5,368,475 A 11/1994 Suppiah et al.
5,406,704 A 4/1995 Retallick
5,461,864 A 10/1995 Betta et al.
5,525,309 A 6/1996 Breuer et al.
5,865,864 A 2/1999 Bruck
5,946,917 A 9/1999 Hums et al.
6,060,173 A 5/2000 Retallick
6,116,014 A 9/2000 Dalla Betta et al.
6,158,222 A 12/2000 Retallick
6,174,159 B1 1/2001 Smith et al.
6,190,784 B1 2/2001 Maus et al.
6,217,832 B1 4/2001 Betta et al.
6,358,040 B1 3/2002 Pfefferle et al.
6,415,608 B1 * 7/2002 Newburry ..... 60/723
6,500,393 B2 12/2002 Nakamori et al.
6,619,043 B2 9/2003 Bruck et al.
6,630,423 B2 10/2003 Alvin et al.

(Continued)

*Primary Examiner*—William H Rodriguez

(57) ABSTRACT

A catalytic combustor (28) includes a tubular pressure boundary element (90) having a longitudinal flow axis (e.g., 56) separating a first portion (94) of a first fluid flow (e.g., 24) from a second portion (95) of the first fluid flow. The pressure boundary element includes a wall (96) having a plurality of separate longitudinally oriented flow paths (98) annularly disposed within the wall and conducting respective portions (100, 101) of a second fluid flow (e.g., 26) therethrough. A catalytic material (32) is disposed on a surface (e.g., 102, 103) of the pressure boundary element exposed to at least one of the first and second portions of the first fluid flow.

19 Claims, 6 Drawing Sheets

U.S. PATENT DOCUMENTS 6,669,914 B1 * 12/2003 Wen et al. ..... 422/180
6,772,583 B2 * 8/2004 Bland ..... 60/39.37
6,889,495 B2 * 5/2005 Hayashi et al. ..... 60/39.37
2002/0182551 A1 12/2002 Carroni et al.

* cited by examiner

CONCENTRIC CATALYTIC COMBUSTOR

CROSS REFERENCE TO RELATED APPLICATIONS

This application is a continuation-in-part of and claims the benefit of the Aug. 13, 2004 filing date of U.S. patent application Ser. No. 10/918,275.

The United States Government has certain rights in this invention pursuant to contract number DE-FC-26-03NT41891 awarded by the Department of Energy.

FIELD OF THE INVENTION

This invention relates generally to gas turbine engines, and, in particular, to a catalytic combustor comprising concentric tubular pressure boundary elements.

BACKGROUND OF THE INVENTION

It is known to use catalytic combustion in gas turbine engines to reduce NOx emissions. One such catalytic combustion technique known as lean catalytic, lean burn (LCL) combustion, involves completely mixing fuel and air to form a lean fuel mixture that is passed over a catalytically active surface prior to introduction into a downstream combustion zone. However, the LCL technique requires precise control of fuel and air volumes and may require the use of a complex preburner to bring the fuel/air mixture to lightoff conditions. An alternative catalytic combustion technique is the rich catalytic, lean burn (RCL) combustion process that includes mixing fuel with a first portion of air to form a rich fuel mixture. The rich fuel mixture is passed over a catalytic surface and mixed with a second portion of air in a downstream combustion zone to complete the combustion process.

U.S. Pat. No. 6,174,159 describes an RCL method and apparatus for a gas turbine engine having a catalytic combustor using a backside cooled design. The catalytic combustor includes a plurality of catalytic modules comprising multiple cooling conduits, such as tubes, coated on an outside diameter with a catalytic material and supported in the catalytic combustor. A portion of a fuel/oxidant mixture is passed over the catalyst coated cooling conduits and is oxidized, while simultaneously, a portion of the fuel/oxidant enters the multiple cooling conduits and cools the catalyst. The exothermally catalyzed fluid then exits the catalytic combustion system and is mixed with the cooling fluid outside the system, creating a heated, combustible mixture.

To reduce the complexity and maintenance costs associated with catalytic modules used in catalytic combustors, simplified designs are needed.

BRIEF DESCRIPTION OF THE DRAWINGS

The invention will be more apparent from the following description in view of the drawings that show.

DETAILED DESCRIPTION OF THE INVENTION

Figure 1:
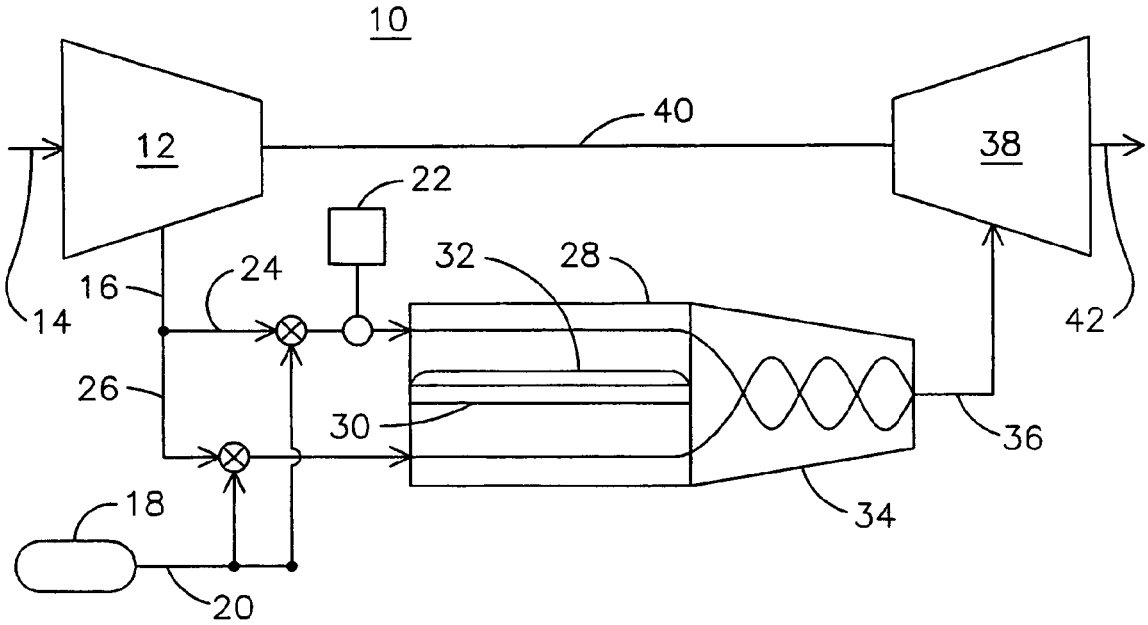
FIG. 1 is a functional diagram of a gas turbine engine including a catalytic combustor.

FIG. 1 illustrates a gas turbine engine 10 having a compressor 12 for receiving a flow of filtered ambient air 14 and for producing a flow of compressed air 16. The compressed air 16 is separated into a combustion mixture fluid flow 24 and a cooling fluid flow 26, respectively, for introduction into a catalytic combustor 28. The combustion mixture fluid flow 24 is mixed with a flow of a combustible fuel 20, such as natural gas or fuel oil for example, provided by a fuel source 18, prior to introduction into the catalytic combustor 28. The cooling fluid flow 26 may be introduced directly into the catalytic combustor 28 without mixing with a combustible fuel. Optionally, the cooling fluid flow 26 may be mixed with a flow of combustible fuel 20 before being directed into the catalytic combustor 28. A combustion mixture flow controller 22 may be used to control the amount of the combustion mixture fluid flow provided to the catalytic combustor 28 responsive to a gas turbine load condition.

Inside the catalytic combustor 28, the combustion mixture fluid flow 24 and the cooling fluid flow 26 are separated by a pressure boundary element 30. In an aspect of the invention, the pressure boundary element 30 is coated with a catalytic material 32 on the side exposed to the combustion mixture fluid flow 24. The catalytic material 32 may have as an active ingredient of precious metals, Group VIII noble metals, base metals, metal oxides, or any combination thereof. Elements such as zirconium, vanadium, chromium, manganese, copper, platinum, palladium, osmium, iridium, rhodium, cerium, lanthanum, other elements of the lanthanide series, cobalt, nickel, iron, and the like may be used.

In a backside cooling embodiment, the opposite side of the pressure boundary element 30 confines the cooling fluid flow 26. While exposed to the catalytic material 32, the combustion mixture fluid flow 24 is oxidized in an exothermic reaction, and the catalytic material 32 and the pressure boundary element 30 are cooled by the unreacted cooling fluid flow 26, thereby absorbing a portion of the heat produced by the exothermic reaction.

After the flows 24,26 exit the catalytic combustor 28, the flows 24,26 are mixed and combusted in a plenum, or combustion completion stage 34, to produce a hot combustion gas 36. The hot combustion gas 36 is received by a turbine 38, where it is expanded to extract mechanical shaft power. In one embodiment, a common shaft 40 interconnects the turbine 38 with the compressor 12 as well as an electrical generator (not shown) to provide mechanical power for compressing the ambient air 14 and for producing electrical power, respectively. The expanded combustion gas 42 may be exhausted directly to the atmosphere or it may be routed through additional heat recovery systems (not shown).

Figure 3:
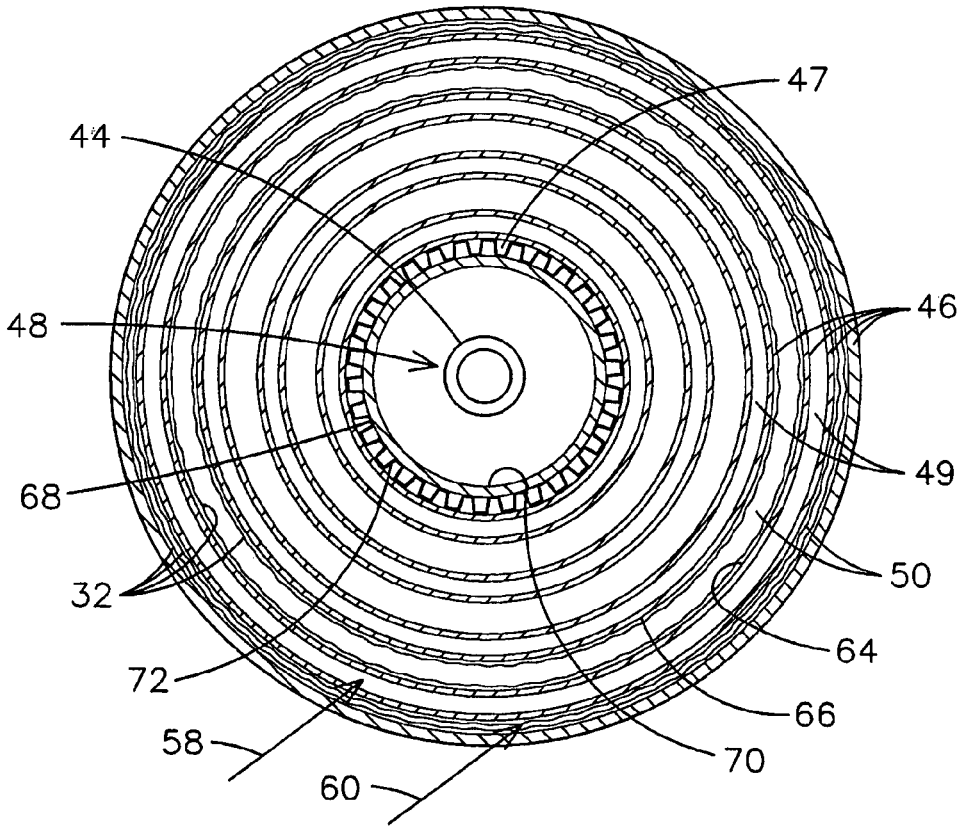
FIG. 3 is a cross sectional view of the concentric catalytic combustor of FIG. 2 as seen along plane 3-3 of FIG. 2.
Figure 2:
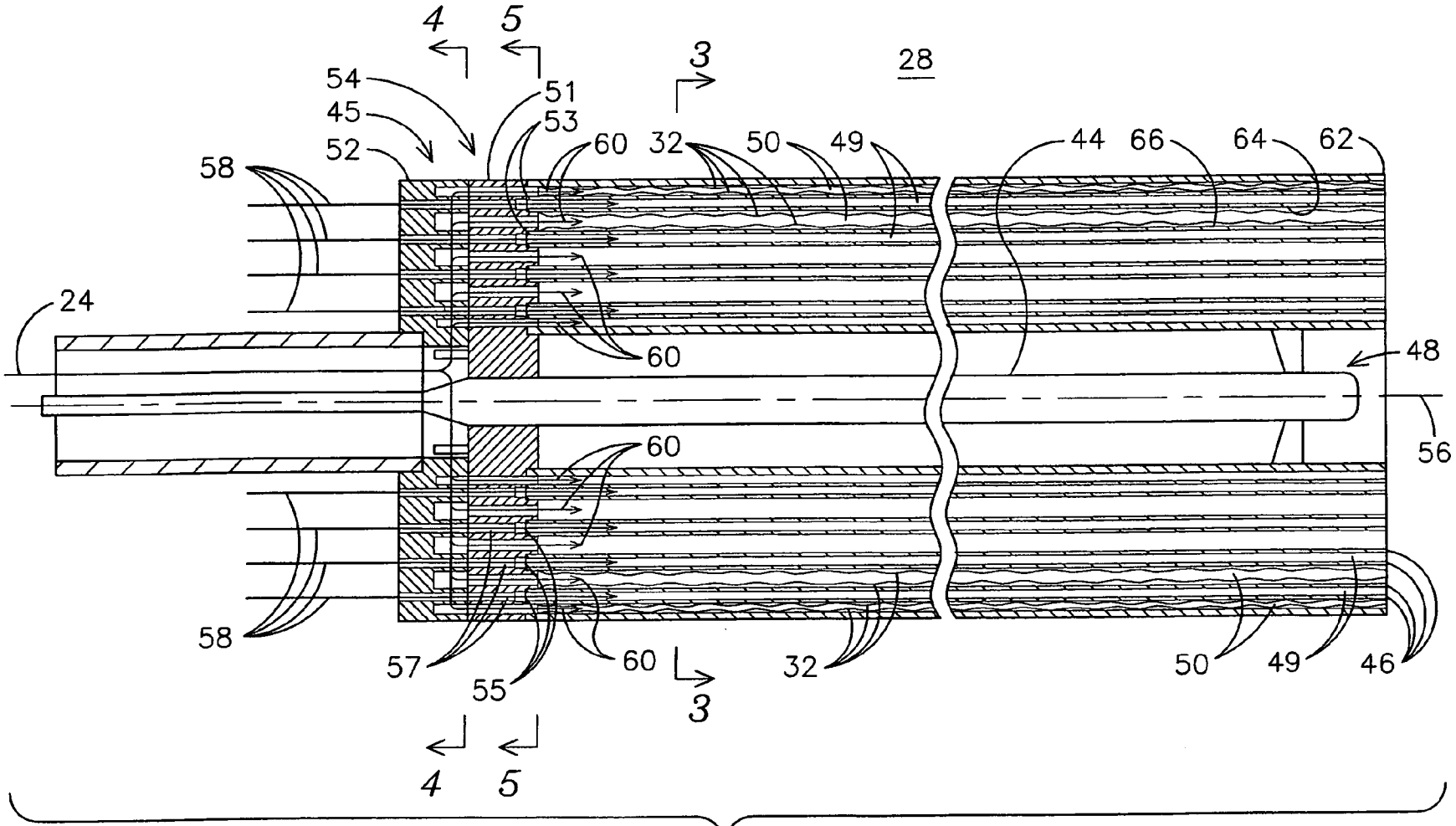
FIG. 2 illustrates an axial cross section of a concentric catalytic combustor taken along a direction of flow though the combustor.

FIG. 2 illustrates a cross section of an improved catalytic combustor 28 including a plurality of concentric tubular pressure boundary elements 46 arranged around a central core region 48. FIG. 3 is a cross sectional view of the catalytic combustor 28 of FIG. 2 as seen along plane 3-3 of FIG. 2, and shows the concentric arrangement of the tubular pressure boundary elements 46 around the central region 48 to form annular spaces, such as spaces 47, 49, 50, for conducting respective fluid flows therethrough. The improved catalytic combustor 28 includes at least one annular space for conducting a first fluid flow therethrough and a second annular space, separate from the first annular space, for conducting a second fluid flow therethrough. A catalytic material is disposed in at least one of the spaces and is exposed to the fluid flowing therethrough.

As used herein, the term "concentric" includes pressure boundary elements centered around the central region 48, not just about a central axis 56. Accordingly, the elements 46 may be offset from one another so that the annular region formed there between may not be a symmetrical annular region. The term "tubular" is meant to include an element defining a flow channel having a circular, rectangular, hexagonal or other geometric cross section. "Annular space" is meant to refer to a peripheral space defined between a first tubular element and a second tubular element disposed around and spaced away from the first tubular element, such as a tubular element having a circular cross section (e.g., a cylindrical element), concentrically disposed around another cylindrical element to form a peripheral space there between.

The combustor 28 may include a manifold assembly 45 attached to an upstream end 54 of the combustor 28 for retaining the pressure boundary elements 46 and receiving and directing fluid flows into the annular spaces 49, 50 between the elements 46. The annular spaces 49, 50 may extend from the manifold assembly 45 to a combustor exit 62. The manifold assembly 45 may include a one-piece assembly, or, in an embodiment, may include a two-piece assembly comprising a manifold 52 and an adapter 51. In another embodiment, a pilot burner 44 may be disposed in the central region 48 to provide a pilot flame for stabilizing flames in the combustion completion stage 34 under various engine loading conditions.

In an aspect of the invention, a first set of spaces 49 may be configured to conduct respective portions 58 of the cooling fluid flow 26, and a second set of spaces 50 may be configured to conduct respective portions 60 of the combustion mixture fluid flow 24. As shown in FIG. 3, the spaces 50 conducting respective portions 60 of the combustion mixture fluid flow 24 may include a catalytic material 32 disposed on a surface of at least one of the pressure boundary elements 46 defining the space 50 and exposed to the portion 60 of the combustion mixture fluid flow 24 flowing in the space 50, thereby forming a catalytically active space. For example, an inner diameter surface 64 of one of the pressure boundary elements 46 forming an annular space 50 may include a catalytic material 32. In another embodiment, an outer diameter surface 66 of one of the pressure boundary elements 46 forming an annular space 50 may include a catalytic material 32. In yet another embodiment, an outer diameter surface 66 of a first boundary element and an inner diameter surface 64 of another pressure boundary element concentrically disposed around the first pressure boundary element may include a catalytic material 32 exposed to a portion 60 of the combustion mixture flow flowing in the space 50 defined by the first and second pressure boundary elements.

In another embodiment, the pressure boundary elements 46 may be configured to form a first set of annular spaces 49 comprising no catalytic material and conducting respective portions 58 of the cooling fluid flow 26 concentrically alternating with a second set of annular spaces 50 including a catalytic material 32 and conducting respective portions 60 of the combustion mixture fluid flow 24. A space 49 having no catalytic material disposed on surfaces defining the space 49 remains catalytically inactive and may conduct a portion of the cooling fluid flow 26 to define a cooling space used to backside cool adjacent catalytically active spaces. Accordingly, the catalytic combustor 28 may comprise a series of concentric tubular pressure boundary elements 46 defining an alternating arrangement of catalytically active annular spaces interspersed by annular cooling spaces. In another aspect of the invention, a pressure boundary element 68 surrounding the central region 48 may include a catalytic material 32 on its inner diameter surface 70 to form a catalytically active channel, or may not include a catalytic material to allow the region to be used as a cooling space.

To provide improved structural rigidity between the pressure boundary elements 46, a support structure 72, may be radially disposed between concentrically adjacent pressure boundary elements 46 within an annular space, such as space 47, defined between elements 46. The support structure 72 radially retains the adjacent pressure boundary elements 46 in a spaced configuration. For example, the support structure 72 may include a corrugated element brazed or welded to one or both of the pressure boundary elements 46 and may extend along an axial length of the combustor 28. In other embodiments, the support structure may include fins or tubular elements disposed in a space 47 between two adjacent elements 46. In an aspect of the invention, the support structure may be disposed in cooling spaces and/or catalytically active spaces. In another aspect, the support structure 72 itself may include a catalytic surface.

Figure 4:
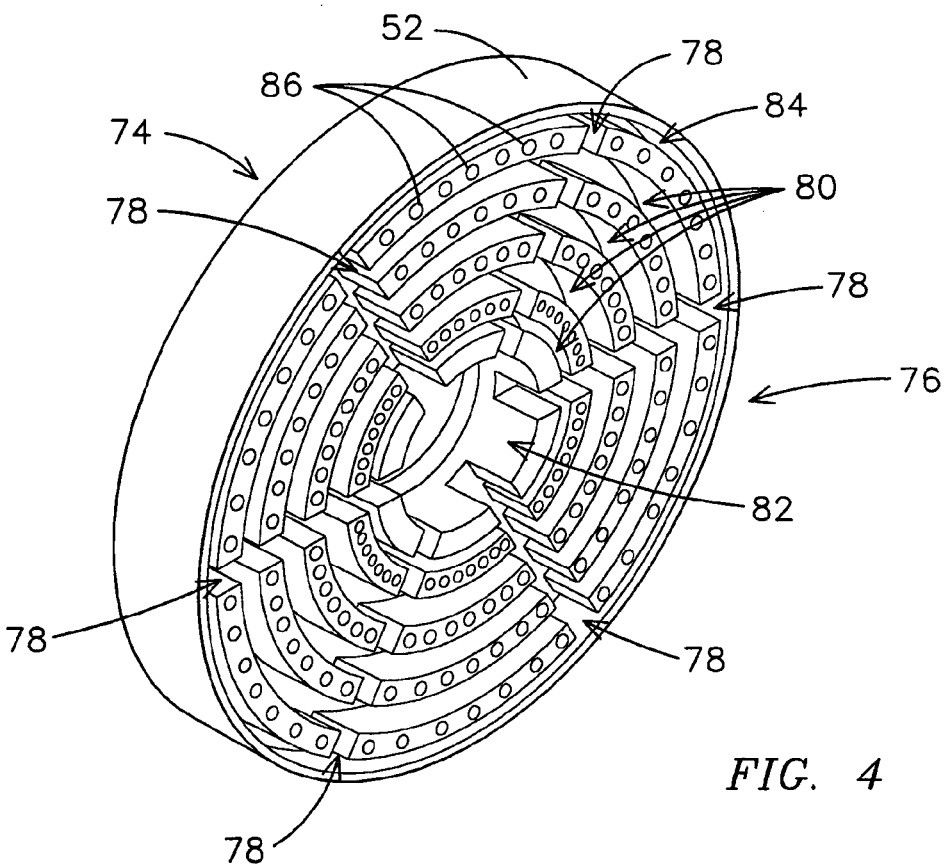
FIG. 4 is a perspective view of a manifold assembly of the concentric catalytic combustor of FIG. 2 as seen along plane 4-4 of FIG. 2.

FIG. 4 is a perspective view of the manifold assembly 45 of the concentric catalytic combustor 28 as seen along plane 4-4 of FIG. 2. Generally, the manifold assembly 45 is configured to receive the combustion mixture fluid flow 24 and the cooling fluid flow 26 on an inlet side 74 and to distribute the flows 24, 26 to the appropriate spaces between the pressure boundary elements 46 attached, such as by brazing, to an outlet side 76 of the manifold assembly 45. For example, respective portions 60 of the combustion mixture fluid flow 24 are delivered to catalytically active spaces and respective portions 58 of the cooling fluid flow 26 are delivered to cooling spaces. In an embodiment, the manifold assembly 45 includes a plurality of angularly spaced apart radial passageways 78 for receiving the combustion mixture fluid flow 24 and conducting portions 60 of the combustion mixture fluid flow 24 into annular spaces 80 formed in the manifold assembly 45 in fluid communication with catalytically active spaces of the concentric catalytic combustor 28. The combustion mixture fluid flow 24 may be introduced at a central opening 82 of the manifold assembly 52 and/or at an inlet (not shown) in fluid communication with a peripheral annular passageway 84. The manifold assembly 52 may also include axial passageways 86 interspersed among and isolated from the radial passageways 78 and the annular spaces 80. The axial passageways 86 receive the respective portions 58 of the cooling fluid flow 26 and conduct the portions 58 into cooling spaces of the concentric catalytic combustor 28. In another embodiment, the radial passageways 78 and the annular spaces 80 may be configured to receive and distribute the cooling fluid flow 26, and the axial passageways 86 may be configured to receive and distribute the combustion mixture fluid flow 24.

Figure 5:
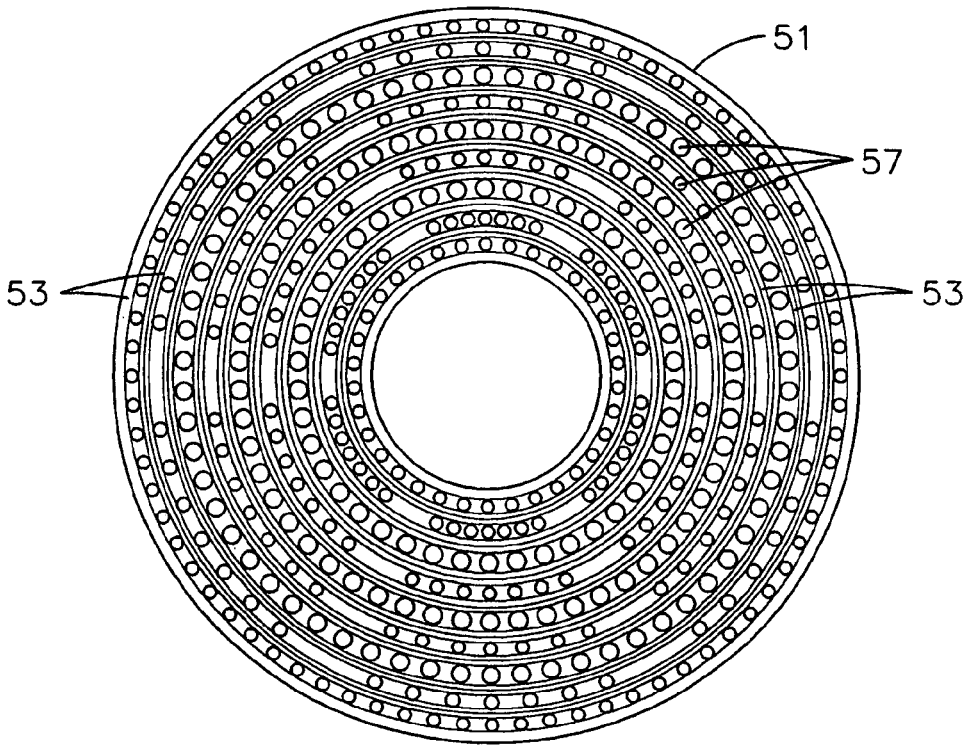
FIG. 5 is an end view of a manifold assembly of the concentric catalytic combustor of FIG. 2 as seen along plane 5-5 of FIG. 2.

As shown in FIGS. 2 and 5, the manifold assembly 52 may include a manifold 52 and an adapter 51 attached to a downstream side 76 of the manifold 52 to connect the pressure boundary elements 46 to the manifold 52 and conduct the portions 58, 60 of the fluid flows 24, 26 from the manifold 52 into the appropriate spaces 49, 50. The adapter 51 may include annular recesses 53 adapted for receiving the upstream ends 55 of the respective pressure boundary elements 46. The upstream ends 55 of the pressure boundary elements 46 may be mechanically attached to the adapter 51, for example, by press fitting, brazing, or welding. The adapter 51 includes passageways 57 extending upstream from the recesses 53 through the adapter 51 to allow fluid communication between the axial passageways 86 and the spaces 49, 50 between the pressure boundary elements 46 installed into the recesses 53. The adapter 51 may be welded or brazed to the downstream side 76 of the manifold 52 so that the manifold assembly 45 may be formed in two pieces to reduce a machining complexity required to manufacture the assembly 45.

In another aspect of the invention, staging of the combustible mixture fluid flow 24 to the catalytic combustor 28 may be accomplished by configuring the combustion mixture flow controller 22 to control the combustible mixture fluid flow 24 to a plurality of catalytically active spaces independently of other catalytically active spaces. For example, the combustion mixture flow controller 22 may be configured to control the combustion mixture flow responsive to a turbine load condition so that under partial loading, only a portion of the catalytically active spaces are fueled, and under full loading of the gas turbine, all of the catalytically active spaces are fueled.

Figure 6:
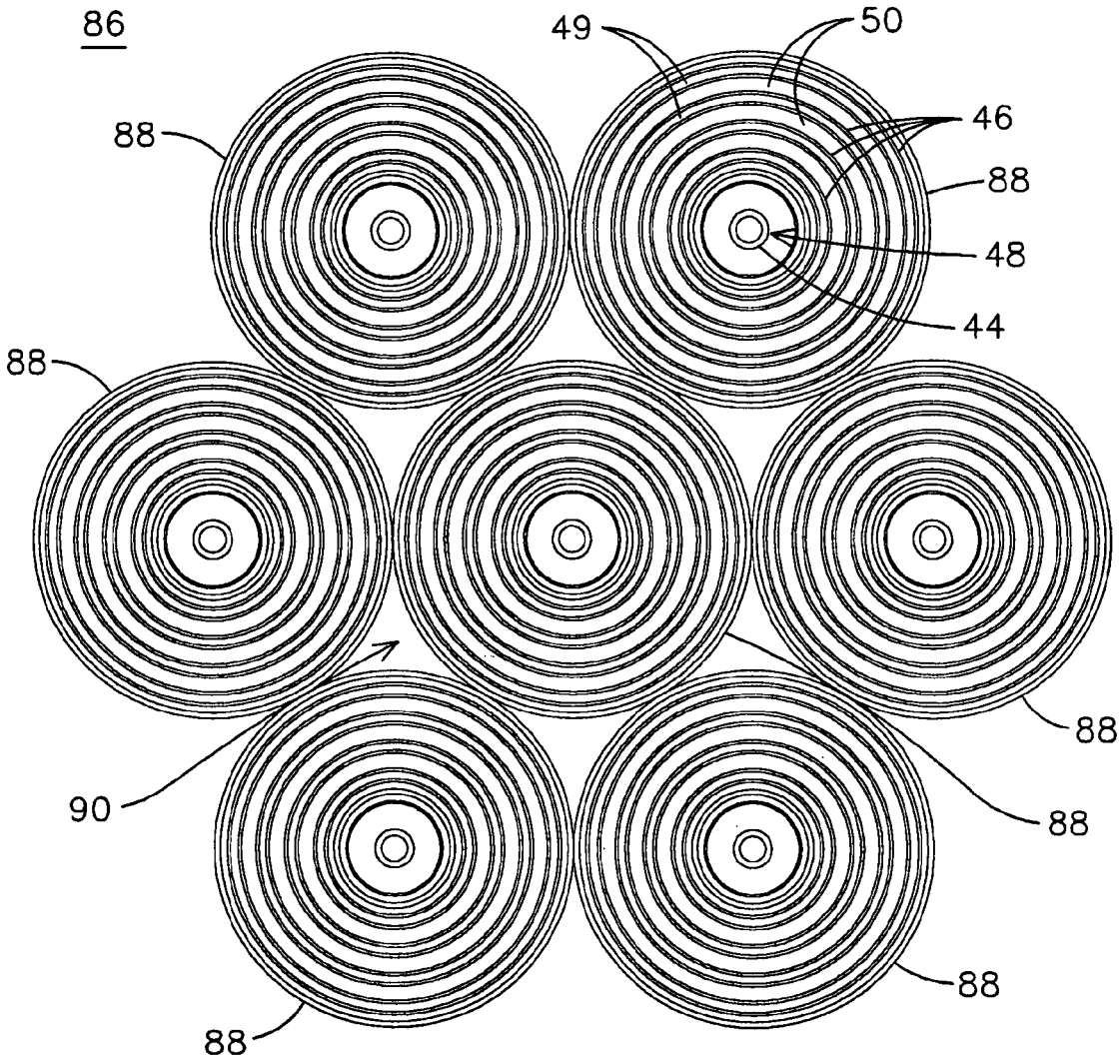
FIG. 6 is a cross sectional view of a catalytic combustor comprising a plurality of concentric catalytic combustor modules arranged around a central region.

In an embodiment depicted in the cross sectional view of FIG. 6, a plurality of concentric catalytic combustion modules 88 (each module having a concentric configuration as described above) may be disposed around a central region 90 to form a catalytic combustor 86. Each module 88 may include a plurality of concentric tubular pressure boundary elements 46 forming annular spaces 50 therebetween. A first set of spaces 49 of each module 88 may conduct a cooling fluid flow and a second set of spaces 50 may conduct a combustible mixture fluid flow. A catalytic surface disposed in the annular spaces 50 conducting a combustible mixture flow (such as on an inner diameter and/or outer diameter surface of the pressure boundary elements defining the spaces 50, as described previously) is exposed to the combustible mixture fluid flow, thereby forming a catalytically active space. Spaces 49 conducting the cooling fluid define cooling spaces providing backside cooling for the catalytically active spaces. For example, catalytically active spaces may be alternated with cooling spaces in each of the catalytic combustion modules to provide a backside cooled, concentric catalytic combustion module 88. Each catalytic module 88 may include a manifold (not shown) attached to an upstream end of the module 88 for directing the combustion mixture flow into catalytically active spaces and the cooling flow into the cooling spaces. In an aspect of the invention, a pilot burner (not shown) may be disposed in the central region 90. In another aspect, a catalytic combustion module 88 may be disposed in the central region 90. In yet another aspect, a pilot burner 44 may be disposed in a central region 48 of one or more of the catalytic combustion modules 88 forming the catalytic combustor 86.

Figure 7:
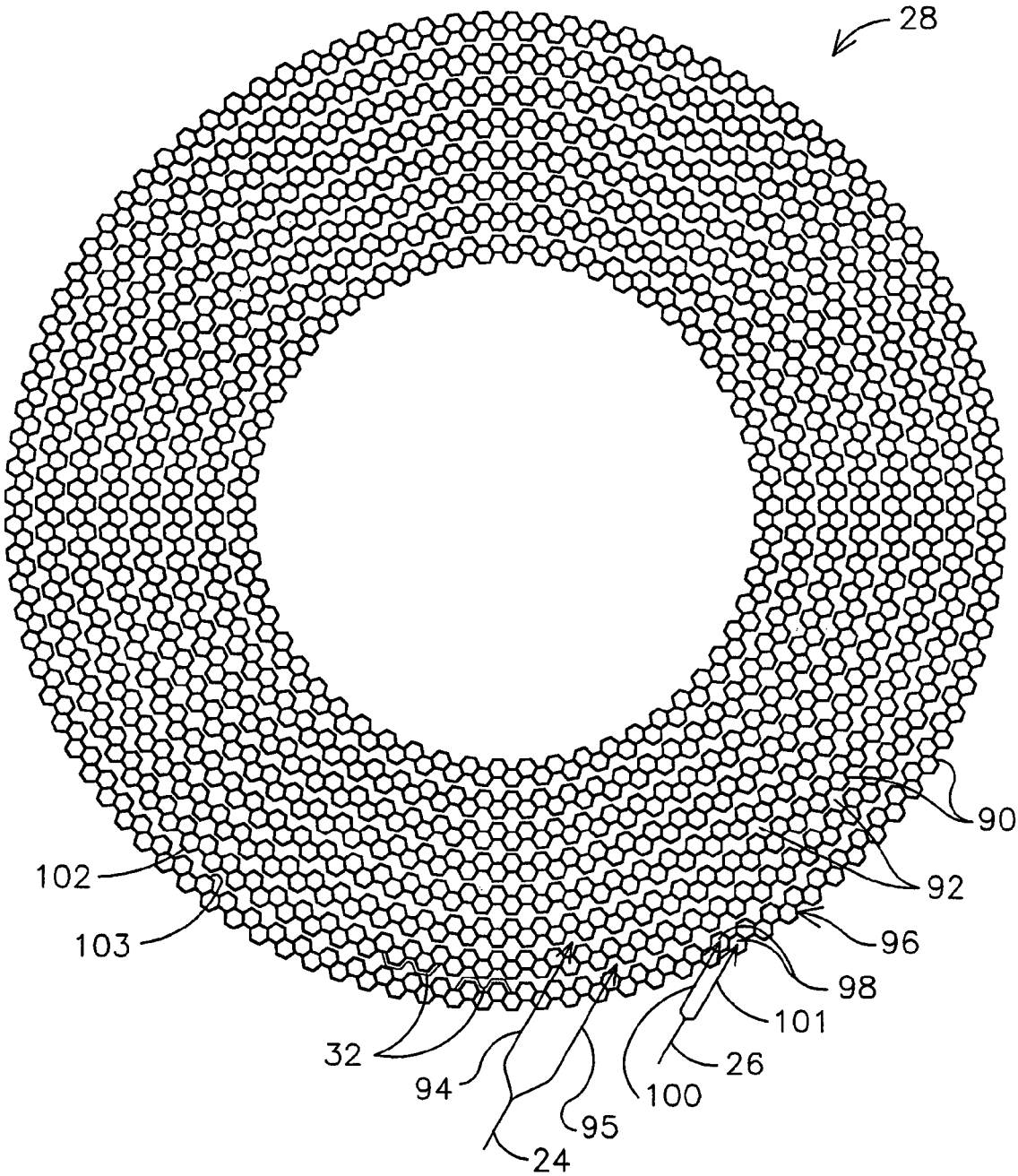
FIG. 7 is a cross sectional view of another embodiment of the concentric catalytic combustor 28 of FIG. 2 as seen along plane 3-3 of FIG. 2.

FIG. 7 is a cross sectional view of another embodiment of the concentric catalytic combustor 28 of FIG. 2 as seen along plane 3-3 of FIG. 2. Each tubular pressure boundary element 90 separates a first portion of a fluid flow from a second portion of the fluid flow and includes a wall 96 having separate flow paths 98 for conducting another fluid flow within the wall 96. The catalytic combustor 28 includes a plurality of concentric tubular pressure boundary elements 90 having respective longitudinal flow axes (for example, central axis 56 as shown in FIG. 2) forming a plurality of concentric annular spaces 92 conducting respective portions 94,94 of a combustible mixture fluid flow 24. Each of the tubular pressure boundary elements 90 includes a wall 96 having a plurality of separate, longitudinally oriented flow paths 98 annularly disposed within the wall 96. For example, the longitudinally oriented flow paths 98 may be oriented parallel with the central axis 56, or may be configured to spiral about the central axis 56. The flow paths 98 within the wall 96 conduct respective portions 100, 101 of a cooling fluid flow 26 therethrough. A catalytic material 32 may be disposed on respective surfaces 102, 103 of the pressure boundary elements and exposed to one or more respective portions 94, 95 of combustible fluid flow 24. For example, the catalytic material 32 may be disposed on one of the surfaces, or a portion thereof (such as inner diameter surface 103 or an outer diameter surface 102) of adjacent elements 90 having opposed surfaces 102, 103 forming an annular space 92 therebetween. In another aspect, the catalytic material 32 may be disposed on both surfaces 102, 103, or portions thereof, forming the annular space 92.

Figure 8:
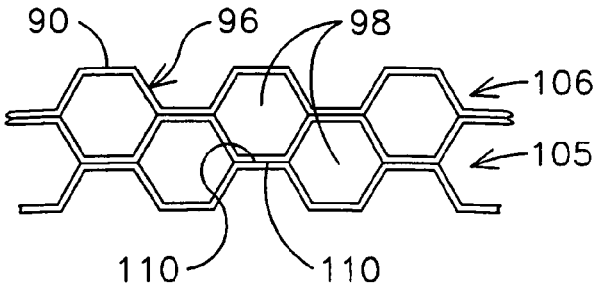
FIG. 8 is partial cross sectional view, taken perpendicular to a direction of fluid flow, of an exemplary embodiment of a pressure boundary element.
Figure 9:
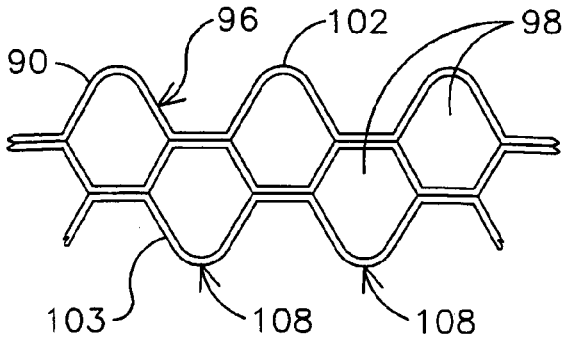
FIG. 9 is partial cross sectional view, taken perpendicular to a direction of fluid flow, of an exemplary embodiment of a pressure boundary element.
Figure 10:
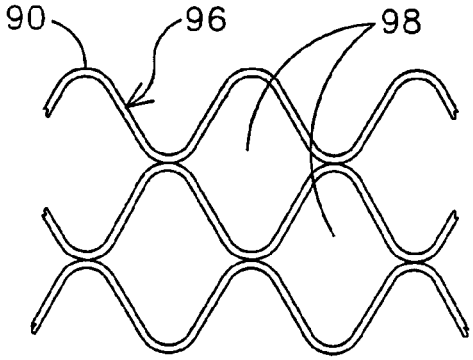
FIG. 10 is partial cross sectional view, taken perpendicular to a direction of fluid flow, of an exemplary embodiment of a pressure boundary element.
Figure 11:
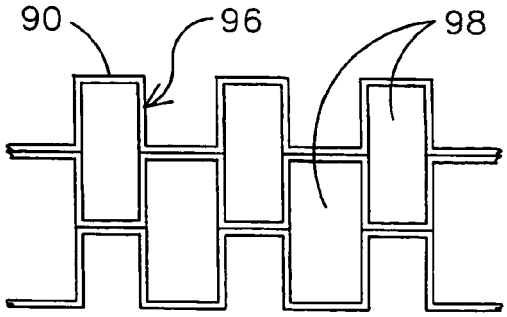
FIG. 11 is partial cross sectional view, taken perpendicular to a direction of fluid flow, of an exemplary embodiment of a pressure boundary element.

In an exemplary embodiment of the invention shown in FIG. 8, each of the plurality of separate flow paths 98 formed in the wall 96 of the pressure boundary element 90 includes a hexagonal cross section, so that the plurality of the flow paths 98 form an annular honeycomb configuration with in the wall 96. Although FIG. 8 depicts the wall 96 as including two annular rings 105, 106 of spaced apart flow paths 98, the wall 96 may include any number of rings to achieve, for example, a desired rigidity. In addition, the flow paths 98 may be sized and shaped to achieve a desired structural and/or cooling characteristic. Other exemplary geometric configurations of flow path cross sections are shown in FIGS. 9-11. FIG. 9 shows a partial honeycomb cross section configuration including rounded portions 108 on the surfaces 102, 103 of the boundary element 90. FIG. 10 shows a corrugated cross section configuration, and FIG. 11 shows a rectangular cross section configuration. Such pressure boundary elements 90 may be formed from two or more corrugated sheets, having corrugations corresponding to desired flow path cross sections, of a high temperature resistant alloy, such as Haynes® 214™ or 230®, laid on top of one another. The sheets may be aligned to form the desired flow paths and attached at points of contact 110 as shown in FIG. 8 The points of contact 110 may be welded, such as by resistance seam welding, but preferably by being brazed together using, for example, brazing alloys such as AWS A5.8 BNi-5 (AMS 4782), so that thermal conduction may be optimize compared to other welding techniques. The resulting attached sheets may then be cut to a desired length to and then rolled for example, into a cylinder, and connected where the edges of the rolled sheet meet to form a tubular pressure boundary element. The diameters of the cylinder may be varied so that a set of pressure boundary elements used to form a catalytic combustor may be nested to provide a concentric arrangement.

Advantages of providing corrugated surfaces, such as surfaces 102, 103, include providing an increased surface area compared to a flat surface, thereby allowing an overall reduction in the number of pressure boundary elements needed to achieve a desired catalytic combustion. In addition, a corrugated or honeycombed structure provides increased rigidity that may better accommodate non-homogeneous reaction of the catalyst and have reduced stresses resulting from differential thermal expansion from one element to another.

The concentric arrangement of tubular pressure boundary elements may be attached to a manifold assembly to direct appropriate fluid flows into corresponding flow paths 98 within the walls 96 of the pressure boundary elements 90 and the annular spaces 92 there between. The manifold assembly 45 depicted in FIG. 4 may be modified by skilled artisan to adapt it for use, for example, with the plurality of boundary elements 90 shown in FIG. 7. The manifold assembly 45 may include a plurality of angularly spaced apart radial passageways 78 receiving the combustion mixture fluid flow 24. The radial passageways 78 may be configured to conduct portions 60 of the combustion mixture fluid flow 24 into the annular spaces 80 formed in the manifold assembly 45 in fluid communication with the annular spaces 92 formed between adjacent pressure boundary elements 90. The combustion mixture fluid flow 24 may be introduced at a central opening 82 of the manifold assembly 52 and/or at an inlet (not shown) in fluid communication with a peripheral annular passageway 84.

The manifold assembly 52 may also include axial passageways 86 interspersed among and isolated from the radial passageways 78 and the annular spaces 80. The axial passageways 86 receive the respective portions 58 of the cooling fluid flow 26 and conduct the portions 58 into the plurality of separate flow paths 98 annularly disposed within the wall 96 of each of the pressure boundary elements 90. In yet another aspect of the invention, a catalytic combustor module 88 having the boundary element configuration depicted in FIG. 7 may be used in the catalytic combustor 86 shown in FIG. 6.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A catalytic combustor comprising:

a tubular pressure boundary element having a longitudinal flow axis separating a first portion of a first fluid flow from a second portion of the first fluid flow and comprising a wall having a plurality of separate, longitudinally oriented flow paths annularly disposed within the wall and conducting respective portions of a second fluid flow therethrough; and a catalytic material disposed on a surface of the pressure boundary element exposed to at least one of the first and second portions of the first fluid flow.

2. The catalytic combustor of claim 1, wherein: the first fluid flow comprises a combustible fluid; and the second fluid flow comprises a cooling fluid containing no combustible fuel.

3. The Catalytic combustor of claim 2, wherein the surface comprises an inner diameter surface of the pressure boundary element.

4. The catalytic combustor of claim 2, wherein the surface comprises an outer diameter surface of the pressure boundary element.

5. The catalytic combustor of claim 1, wherein each of the plurality of separate flow paths comprises a hexagonal cross section.

6. The catalytic combustor of claim 1, wherein each of the plurality of separate flow paths comprises a rectangular cross section.

7. The catalytic combustor of claim 1, wherein each of the plurality of separate flow paths comprises a corrugated cross section.

8. The catalytic combustor of claim 1, wherein the plurality of separate flow paths comprise a first annular ring of spaced apart channels and a second annular ring of spaced apart channels formed radially outward of the first ring so that the channels of the second annular ring fit at least partially radially inward within corresponding spaces formed by the first annular ring of channels.

9. A catalytic combustor comprising:

a plurality of concentric tubular pressure boundary elements having respective longitudinal flow axes forming a plurality of concentric annular spaces conducting respective portions of a combustible fluid flow; each of the tubular pressure boundary elements comprising a wall comprising a plurality of separate, longitudinally oriented flow paths annularly disposed within the wall and conducting respective portions of a cooling fluid flow therethrough; and a catalytic material disposed on respective surfaces of the pressure boundary elements and exposed to the respective portions of the combustible fluid flow.

10. The catalytic combustor of claim 9, wherein the catalytic material is disposed on one surface of adjacent elements having opposed surfaces forming an annular space there between.

11. The catalytic combustor of claim 9, wherein the catalytic material is disposed on both surfaces of adjacent elements having opposed surfaces forming an annular space there between.

12. The catalytic combustor of claim 9, further comprising a manifold assembly attached to an upstream end of the combustor, the manifold assembly comprising a radial passageway receiving the combustible fluid flow and conducting the combustible fluid flow into annular spaces formed in the manifold assembly in fluid communication with respective annular spaces formed by the plurality of concentric tubular pressure boundary elements.

13. The catalytic combustor of claim 12, the manifold assembly comprising a central opening receiving the combustible fluid flow and conducting the combustible fluid flow into the radial passageway.

14. The catalytic combustor of claim 13, the manifold assembly comprising an axial passageway remote from the radial passageways receiving the cooling fluid flow and conducting the cooling fluid flow into the plurality of separate flow paths annularly disposed within each of the pressure boundary elements.

15. A gas turbine engine comprising the combustor of claim 9.

16. A method for using a combustor to oxidize a combustible fluid flow, the method comprising:

providing a plurality of concentric tubular pressure boundary elements having respective longitudinal flow axes forming a plurality of concentric annular spaces conducting respective portions of a combustible fluid flow; each of the tubular pressure boundary elements comprising wall comprising a plurality of separate, longitudinally oriented flow paths annularly disposed within the wall and conducting respective portions of a cooling fluid flow therethrough;

providing a catalytic material on respective surfaces of the pressure boundary elements and exposed to the respective portions of the combustible fluid flow;

conducting respective portions of the combustible fluid flow through the plurality of concentric annular spaces to expose the combustible fluid flow to the catalytic material and produce a partially oxidized fluid flow; and conducting respective portions of the cooling fluid flow through the flow paths annularly disposed within the wall to provide cooling of the combustible fluid flow while the combustible flow is being conducted through the annular spaces.

17. A catalytic combustor comprising:

a plurality of catalytic combustion modules, each module comprising a plurality of concentric tubular pressure boundary elements having respective longitudinal flow axes forming a plurality of concentric annular spaces conducting respective portions of a combustible fluid flow, each of the tubular pressure boundary elements comprising a wall having a plurality of separate, longitudinally oriented flow paths annularly disposed within the wall and conducting respective portions of a cooling fluid flow therethrough;

one of the plurality of the modules disposed along a central axis of the combustor;

remaining ones of the plurality of modules circumferentially disposed about the central axis radially outward of the one of the plurality of modules; and each module comprising a pilot burner disposed in a central region of the respective module.

18. A catalytic combustor comprising:

a plurality of catalytic combustion modules, each module comprising a plurality of concentric tubular pressure boundary elements having respective longitudinal flow axes forming a plurality of concentric annular spaces conducting respective portions of a combustible fluid flow, each of the tubular pressure boundary elements comprising a wall having a plurality of separate, longitudinally oriented flow paths annularly disposed within the wall and conducting respective portions of a cooling fluid flow therethrough; and each module circumferentially disposed about a central axis radially outward of a central region of the combustor.

19. The catalytic combustor of claim 18, further comprising a pilot burner disposed in the central region.

* * * * *